US010281876B2

(12) United States Patent
Umenai et al.

(10) Patent No.: US 10,281,876 B2
(45) Date of Patent: May 7, 2019

(54) NOISE REDUCING STRUCTURE AND IMAGE FORMING APPARATUS

(71) Applicant: FUJI XEROX CO., LTD., Tokyo (JP)

(72) Inventors: Ko Umenai, Kanagawa (JP); Fuyuki Kokubu, Kanagawa (JP); Takayuki Suehiro, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/916,244

(22) Filed: Mar. 8, 2018

(65) Prior Publication Data

US 2019/0094799 A1 Mar. 28, 2019

(30) Foreign Application Priority Data

Sep. 26, 2017 (JP) ..... 2017-184313

(51) Int. Cl.
*G03G 21/00* (2006.01)
*G03G 21/20* (2006.01)
*G03G 21/16* (2006.01)

(52) U.S. Cl.
CPC ..... *G03G 21/20* (2013.01); *G03G 21/1619* (2013.01)

(58) Field of Classification Search
CPC .... G03G 21/20; G03G 21/1619; G03G 21/16; G03G 15/00; G03G 15/757; G03G 2221/1678; G10K 11/16
See application file for complete search history.

(56) References Cited

U.S. PATENT DOCUMENTS

2015/0243274 A1* 8/2015 Hirakawa ..... G03G 21/20 399/91
2017/0053633 A1* 2/2017 Ishida ..... G03G 21/1619
2017/0221469 A1* 8/2017 Ishida ..... G03G 21/1619

FOREIGN PATENT DOCUMENTS

| | | |
|---|---|---|
| JP | 2000-235396 | 8/2000 |
| JP | 2002-023598 | 1/2002 |
| JP | 2003-043861 | 2/2003 |
| JP | 2015-169701 | 9/2015 |

* cited by examiner

*Primary Examiner* — Sophia S Chen
(74) *Attorney, Agent, or Firm* — JCIPRNET

(57) ABSTRACT

A noise reducing structure includes an internal structural body that includes a noise source; an exterior body that includes an inner side surface facing the internal structural body and that covers an outer side of the internal structural body; a space portion that is surrounded by an erected wall, the internal structural body, and the inner side surface, the erected wall being erected so as to, from one of the internal structural body and the inner side surface towards the other of the internal structural body and the inner side surface, be connected to the other of the internal structural body and the inner side surface; and a sound absorbing opening portion that is connected to the space portion and that is formed at a portion near the noise source.

17 Claims, 13 Drawing Sheets

NOISE REDUCING STRUCTURE AND IMAGE FORMING APPARATUS

CROSS-REFERENCE TO RELATED APPLICATIONS

This application is based on and claims priority under 35 USC 119 from Japanese Patent Application No. 2017-184313 filed Sep. 26, 2017.

BACKGROUND

Technical Field

The present invention relates to a noise reducing structure and an image forming apparatus.

SUMMARY

According to an aspect of the invention, there is provided a noise reducing structure including an internal structural body that includes a noise source; an exterior body that includes an inner side surface facing the internal structural body and that covers an outer side of the internal structural body; a space portion that is surrounded by an erected wall, the internal structural body, and the inner side surface, the erected wall being erected so as to, from one of the internal structural body and the inner side surface towards the other of the internal structural body and the inner side surface, be connected to the other of the internal structural body and the inner side surface; and a sound absorbing opening portion that is connected to the space portion and that is formed at a portion near the noise source.

BRIEF DESCRIPTION OF THE DRAWINGS

Exemplary embodiments of the present invention will be described in detail based on the following figures, wherein.

DETAILED DESCRIPTION

Exemplary embodiments of the present invention are described below with reference to the drawings.

First Exemplary Embodiment

Figure 1:
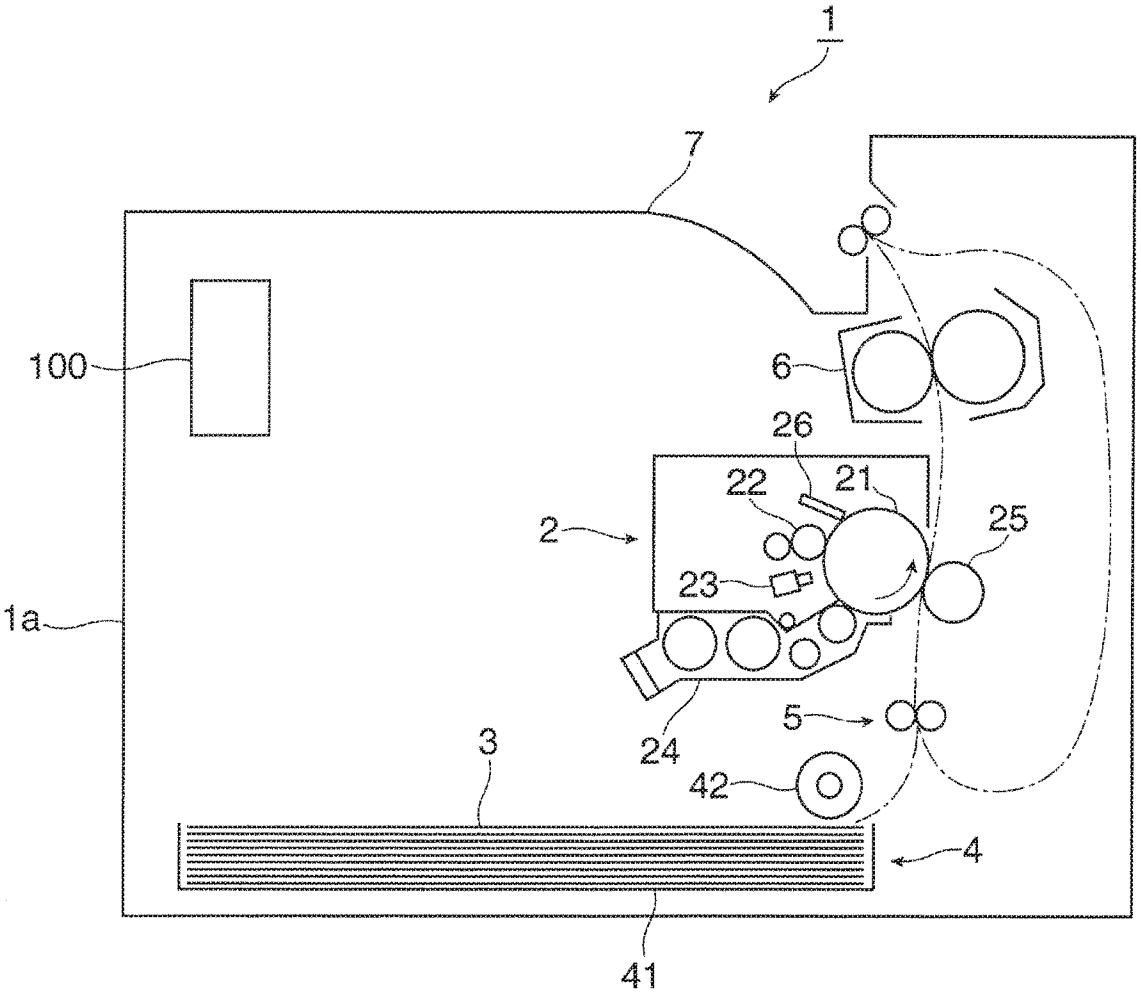
FIG. 1 is a schematic view of a structure of an image forming apparatus to which a noise reducing structure according to a first exemplary embodiment of the present invention is applied.

FIG. 1 is a schematic view of a structure of an entire image forming apparatus 1 to which a noise reducing structure according to a first exemplary embodiment is applied.

Structure of Entire Image Forming Apparatus

The image forming apparatus 1 according to the first exemplary embodiment is, for example, a monochrome printer. The image forming apparatus 1 includes, for example, an image forming unit 2 that forms a toner image (image) formed by performing development with toner of developer; a sheet-feeding unit 4 that supplies recording paper 3, serving as an exemplary recording medium, to the image forming unit 2; a transporting unit 5 that transports to, for example, the image forming unit 2 pieces of recording paper 3 that are supplied one at a time from the sheet-feeding unit 4; and a fixing unit 6 that performs fixing on the recording paper 3 on which the toner image has been formed by the image forming unit 2.

The image forming unit 2 forms an image on a surface of recording paper 3 by performing an electrophotographic process that uses developer. The image forming unit 2 includes, for example, a photoconductor drum 21, serving as an exemplary image carrier; a charging device 22 that charges a peripheral surface of the photoconductor drum 21; an exposure device 23 that exposes the photoconductor drum 21 and forms an electrostatic latent image; a developing device 24 that supplies developer to the electrostatic latent image on the photoconductor drum 21 and develops the electrostatic latent image; a transfer device 25 that transfers the toner image formed on the photoconductor drum 21 to the recording paper 3; and a cleaning device 26 that cleans the peripheral surface of the photoconductor drum 21. The transfer device 25 may be one that does not directly transfer the toner image to the recording paper 3 from the photoconductor drum 21. That is, the transfer device 25 may be one that transfers the toner image to the recording paper 3 via an intermediate transfer body, such as an intermediate transfer belt. The developer may contain, for example, black toner. The developer may contain, in addition to black toner, color toners, such as yellow toner, magenta toner, and cyan toner.

The sheet-feeding unit 4 includes, for example, a holding container 41 that holds recording paper 3 and a sheet-feeding roller 42 that feeds pieces of the recording paper 3 one at a time from the holding container 41. By setting the holding container 41 at an apparatus body 1*a* of the image forming apparatus 1, the sheet-feeding unit 4 is capable of supplying the pieces of recording paper 3 held in the holding container 41. The holding container 41 is mounted such that, for example, the holding container 41 is capable of being drawn out towards the front of the apparatus body 1*a* (towards a side surface that a user faces when the user operates the image forming apparatus 1), that is, towards a side of a left side surface in the illustrated example.

The transporting unit 5 transports recording paper 3 that is fed from the sheet-feeding unit 4 to the image forming unit 2 and the fixing unit 6 to discharge the recording paper 3 on which the image has been formed to a discharging section 7 that is disposed at a top portion of the apparatus body 1*a*. When images are to be formed on both surfaces of the recording paper 3, the transporting unit 5 re-transports the recording paper 3 on which the image has been formed on one surface thereof to the image forming unit 2 with the front and back surfaces of this recording paper 3 being reversed without discharging this recording paper 3 to the discharging section 7.

The fixing unit 6 fuses the toner image, formed on the surface of the recording paper 3 by the image forming unit 2, by using heat and pressure, and fixes the toner image to the recording paper 3. The recording paper 3 to which the image has been fixed by the fixing unit 6 is discharged to and is held by the discharging section 7 with the recording paper 3 placed thereon.

In FIG. 1, reference numeral 100 denotes a controlling device that performs overall control on the operation of the image forming apparatus 1.

Structure of Apparatus Body of Image Forming Apparatus

Figure 2A:
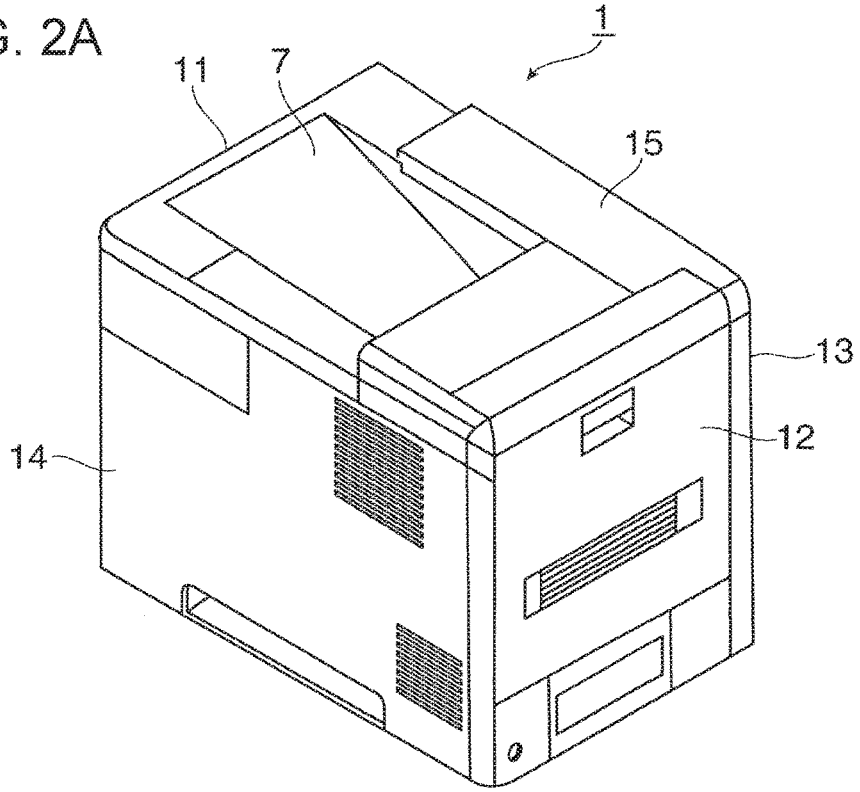
FIGS. 2A and 2B are each a perspective view of a structure of an apparatus body of the image forming apparatus according to the first exemplary embodiment of the present invention.

As shown in FIG. 2A, the apparatus body 1*a* of the image forming apparatus 1 is formed as a box body whose external shape is a substantially rectangular parallelepiped shape. The apparatus body 1*a* includes a front cover 11, a rear cover 12, left and right side covers 13 and 14, and an upper cover 15. The front cover 11 is an example of an exterior body that covers a front surface (a left side surface in FIG. 2A) of the apparatus body 1*a*. The rear cover 12 is an example of an exterior body that covers a rear surface of the apparatus body 1*a*. The left and right side covers 13 and 14 are examples of exterior bodies that cover left and right side surfaces of the apparatus body 1*a*, corresponding thereto. The upper cover 15 is an example of an exterior body that covers an upper portion of the apparatus body 1*a*. Of these covers, for example, the rear cover 12 and the right side cover 14 are provided so as to be openable and closable as appropriate.

Figure 2B:
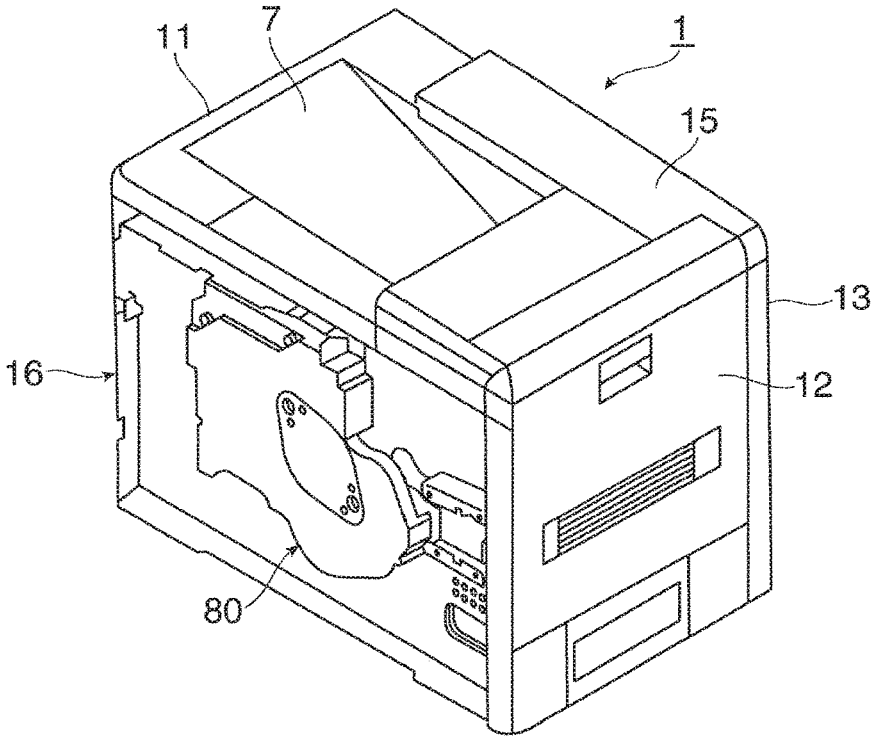

As shown in FIG. 2B in which the right side cover 14 is removed, the apparatus body 1*a* includes a frame structural member serving as an exemplary internal structural body that is covered by the exterior bodies. The frame structural member includes, for example, left and right side frames 16 (the left side frame is not shown) and a connecting frame (not shown). The left and right side frames 16 are disposed on the left and right side surfaces of the apparatus body 1*a* corresponding thereto. The connecting frame connects the left and right side frames 16 on a forward surface side and on a rear surface side of the apparatus body 1*a* corresponding thereto.

Various members that constitute, for example, the image forming unit 2, the sheet-feeding unit 4, the transporting unit 5, and the fixing unit 6 are mounted on the left and right side frames 16. A driving device 80 that drives, for example, the image forming unit 2, the sheet-feeding unit 4, or the transporting unit 5 is mounted on the right side frame 16.

Figure 3:
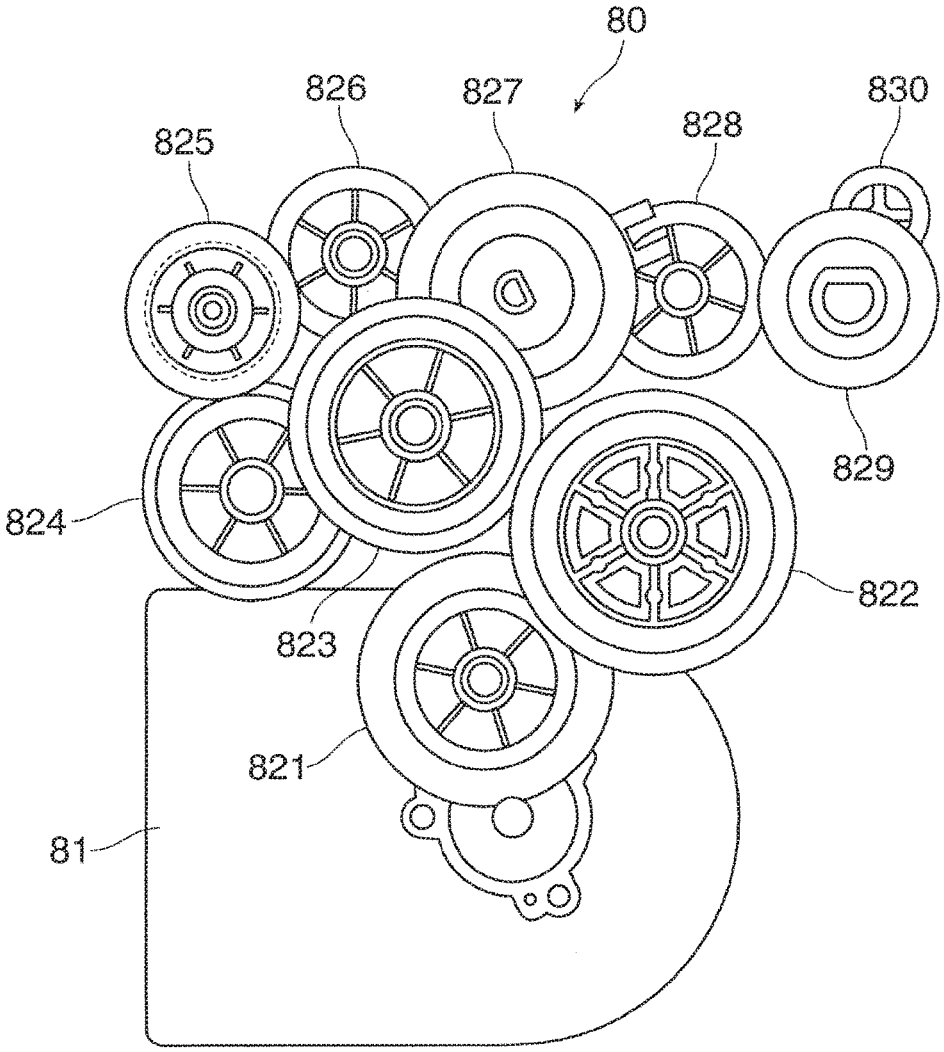
FIG. 3 illustrates a structure of a driving device.

As shown in FIG. 3, the driving device 80 includes, for example, a driving motor 81 and multiple driving force transmission gears 821 to 830. The driving motor 81 serves as a driving source. The multiple driving force transmission gears 821 to 830 transmit driving force of the driving motor 81 to rotary bodies, such as the photoconductor drum 21 and the developing device 24 of the image forming unit 2, the sheet-feeding unit 4, the transporting unit 5, and the fixing unit 6.

Figure 4:
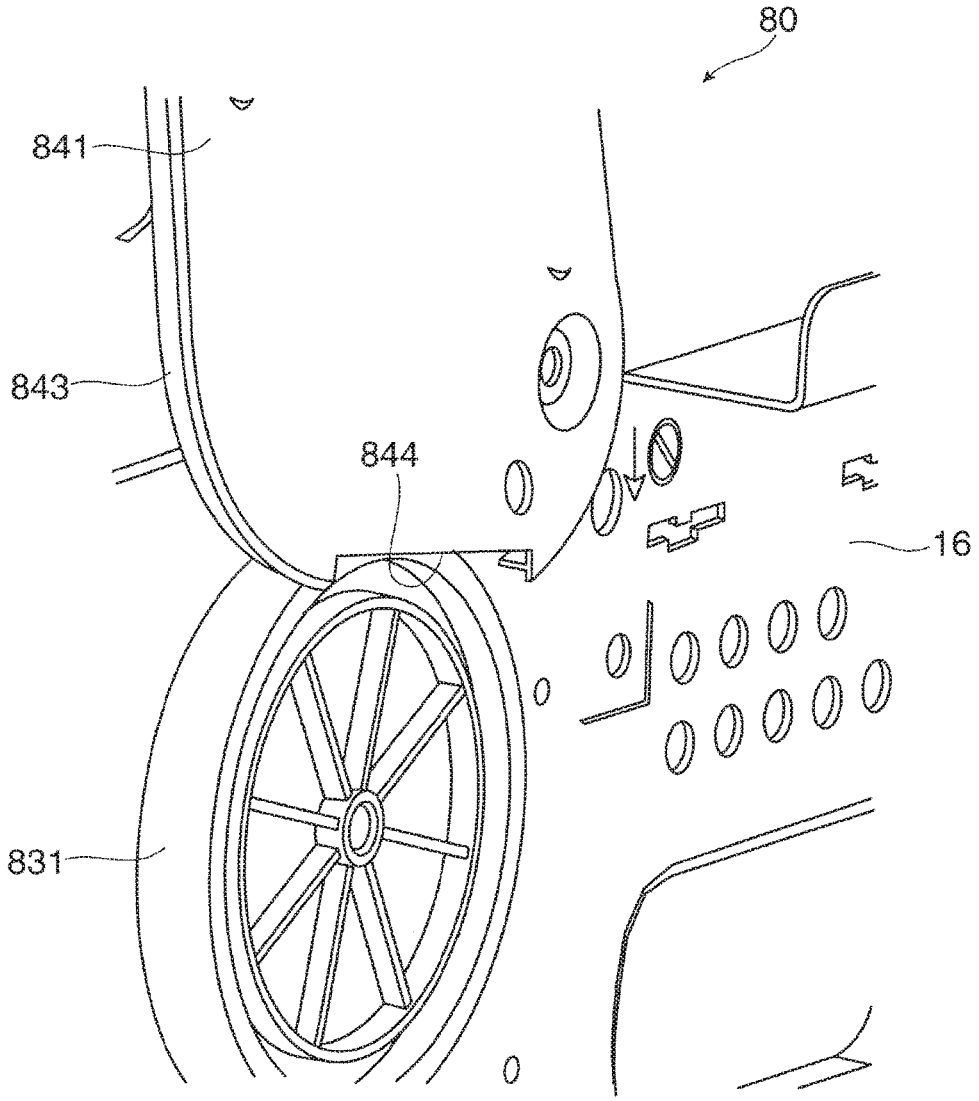
FIG. 4 is a perspective view of the structure of the driving device.

As shown in FIG. 1, as rotary bodies that are rotationally driven by the driving device 80, there exist rotary bodies having, for example, various outside diameters, made of various materials, and having various weights, such as the photoconductor drum 21, a developing roller and stirring-and-transporting member of the developing device 24, the sheet-feeding roller 42 of the sheet-feeding unit 4, transporting rollers of the transporting unit 5, and a heating roller of the fixing unit 6. Of these rotary bodies, the rotary body having the largest outside diameter and weight is the photoconductor drum 21. When the velocity (the peripheral velocity) of each rotary body that is determined on the basis of a process speed of the image forming apparatus 1 is fixed, the rotation velocity of the photoconductor drum 21 having the largest outside diameter is the lowest. Therefore, of the driving force transmission gears that transmit rotational driving force of the driving motor 81, as shown in FIG. 4, the outside diameter of a driving force transmission gear 831 that transmits the rotational driving force to the photoconductor drum 21 is the largest. As a result, the frequency of a driving sound that is generated from, for example, the driving force transmission gear 831 that transmits the rotational driving force to the photoconductor drum 21 becomes the lowest, so that the driving sound becomes a sound having a relatively low frequency of 1000 Hz (1 KHz) or less.

When performing an image forming operation, the image forming apparatus 1 generates a driving sound due to the driving device 80 rotationally driving, for example, the image forming unit 2, the sheet-feeding unit 4, the transporting unit 5, and the fixing unit 6. In addition, the image forming apparatus 1 generates, for example, an electrostatic discharge sound or a mechanical sliding friction sound that is generated when each step, such as a charging step on the surface of the photoconductor drum 21, a developing step, a transfer step, a sheet-feeding step, and a transporting step, is performed. For example, various driving sounds, discharge sounds, and sliding friction sounds that are generated by the image forming apparatus 1 leak to the outside of the apparatus body 1*a* and become noises. Among the various noises that are generated by the image forming apparatus 1, the principal noise is a mechanical driving sound that is generated by the driving device 80. Of mechanical driving sounds that are generated by the driving device 80, in particular, sound having a relatively low frequency of 1000 Hz (1 KHz) or less is difficult to attenuate sufficiently at, for example, the front cover 11, the rear cover 12, the side covers 13 and 14, and the upper cover 15, which have required thicknesses and are made of synthetic resin or the like (refer to paragraph [0012] of PTL 1).

In PTL 1, which is cited as a related art document, a resonance space corresponding to the frequency that is generated during operation is formed between an exterior member and an interior member. The resonance space in PTL 1 constitutes a Helmholtz resonator as described in the detailed description of the invention. As is publicly known, a Helmholtz resonator is a device in which air existing in the inside of a container having an open portion acts as a spring and resonates, and has a silencing effect of attenuating sound due to resonating air vibration passing through the open portion.

However, a Helmholtz resonator has technical problems in that since the air existing in the inside of the container acts as a spring, the device tends to be large; and in that since the attenuating effect is produced by using the open portion, the silencing effect is not easily sufficiently produced. In particular, when a Helmholtz resonator is used to absorb sound having a low frequency, the size of the device is increased.

Regarding such technical problems, paragraph [0007] in PTL 3 that is cited as a related art document and that provides an electrical device including a Helmholtz arrester states that "However, in the case described in PTL 2, the noise reducing effect that is actually obtained is less than the expected noise reducing effect". Incidentally, PTL 2 that is discussed in paragraph [0007] in PTL 3 refers to Japanese Unexamined Patent Application Publication No. 2003-43861 in which a Helmholtz resonator is similarly used.

In the exemplary embodiment, even when it is difficult to provide spaces having sufficient volumes, in order to make it is possible to reduce noise that is generated from a noise source by using space portions formed by the exterior bodies and the internal structural body, a structure includes a space portion surrounded by an erected wall, the internal structural body, and the inner side surfaces of the exterior bodies, and a sound absorbing opening portion that opens into the space portion so as to take in sound waves from the noise source. The erected wall is provided in a erected state so as to, from one of the internal structural body and the inner side surfaces of the exterior bodies towards the other of the internal structural body and the inner side surfaces of the exterior bodies, be contact the other of the internal structural body and the inner side surfaces of the exterior bodies.

In the exemplary embodiment, attention is paid to a function as a resonator that generates a standing wave of sound of a particular frequency in a space portion formed with a tubular shape or the like, instead of to a Helmholtz resonator in which air existing in the inside of a container having an open portion acts as a spring. Moreover, this is based on a new technical idea that, instead of forming a resonator simply as an independent structural body, uses air that is formed by using the exterior bodies and the internal structural body including a noise source.

That is, the internal structural body including a noise source directly forms a space portion that causes resonance to occur. Since the internal structural body includes a noise source, noise generated by the noise source is directly guided to the space portion that causes resonance to occur via the internal structural body.

Even more specifically, as shown in FIGS. 5 to 8, the right side frame 16 of the image forming apparatus 1 is formed with rectangular side surfaces by, for example, press working or welding a metal plate. The right side frame 16 is formed with a high rigidity by forming it with the shape of a frame body as a result of outwardly bending outer peripheral edges 161 to 164 thereof. A housing (bracket) 840 of the driving device 80 that is made from, for example, a metal plate or synthetic resin is, in a fixed state, mounted on an outer side surface of the right side frame 16. The driving force transmission gears 821 to 830 and 831 of the driving device 80 and multiple rotatory shafts (not shown) that support the driving force transmission gears 821 to 830 and 831 are disposed in the inside of the housing 840 of the driving device 80 perpendicularly to a surface of the right side frame 16.

Figure 5:
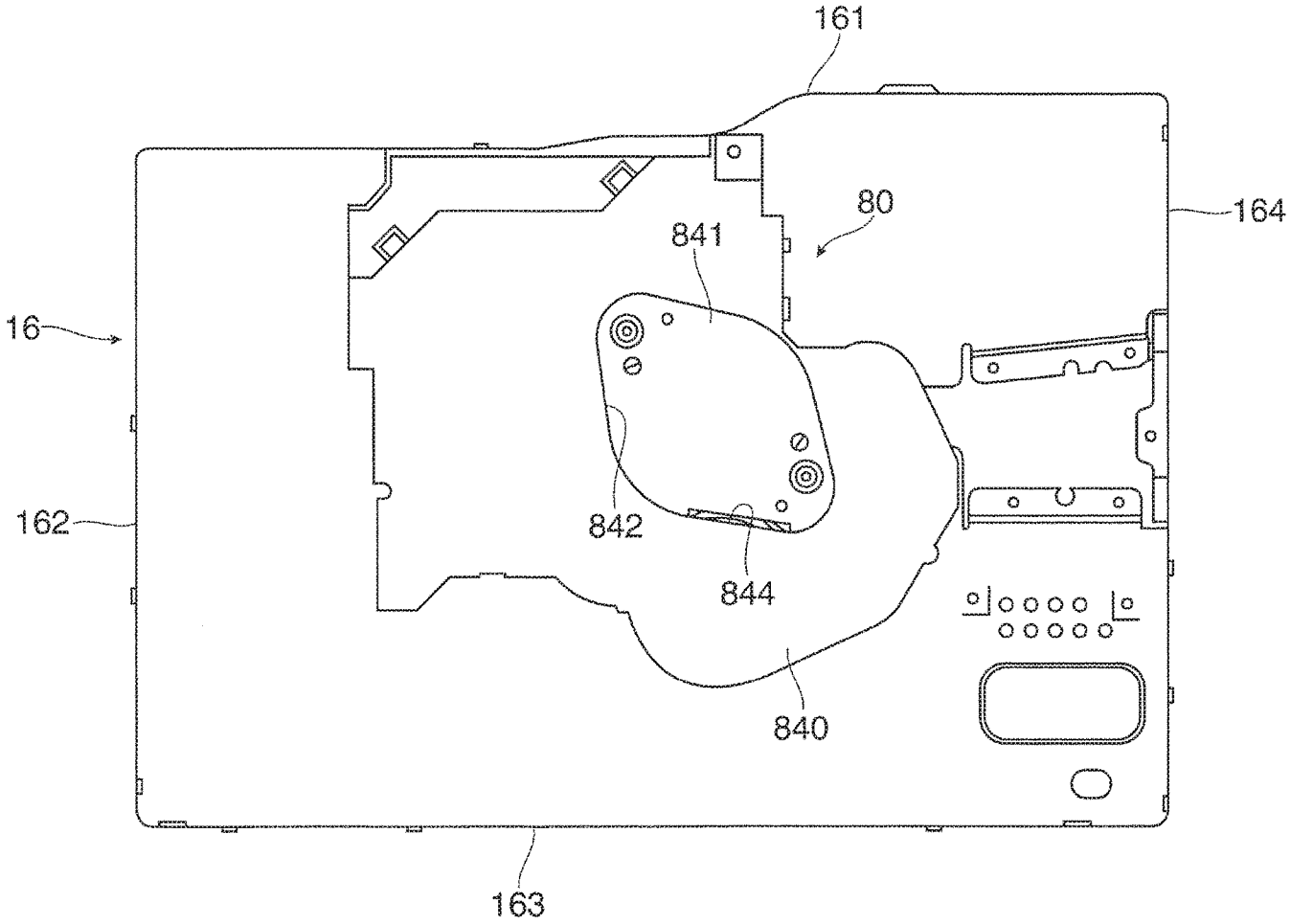
FIG. 5 is a side view of a structure of a right side frame.
Figure 6:
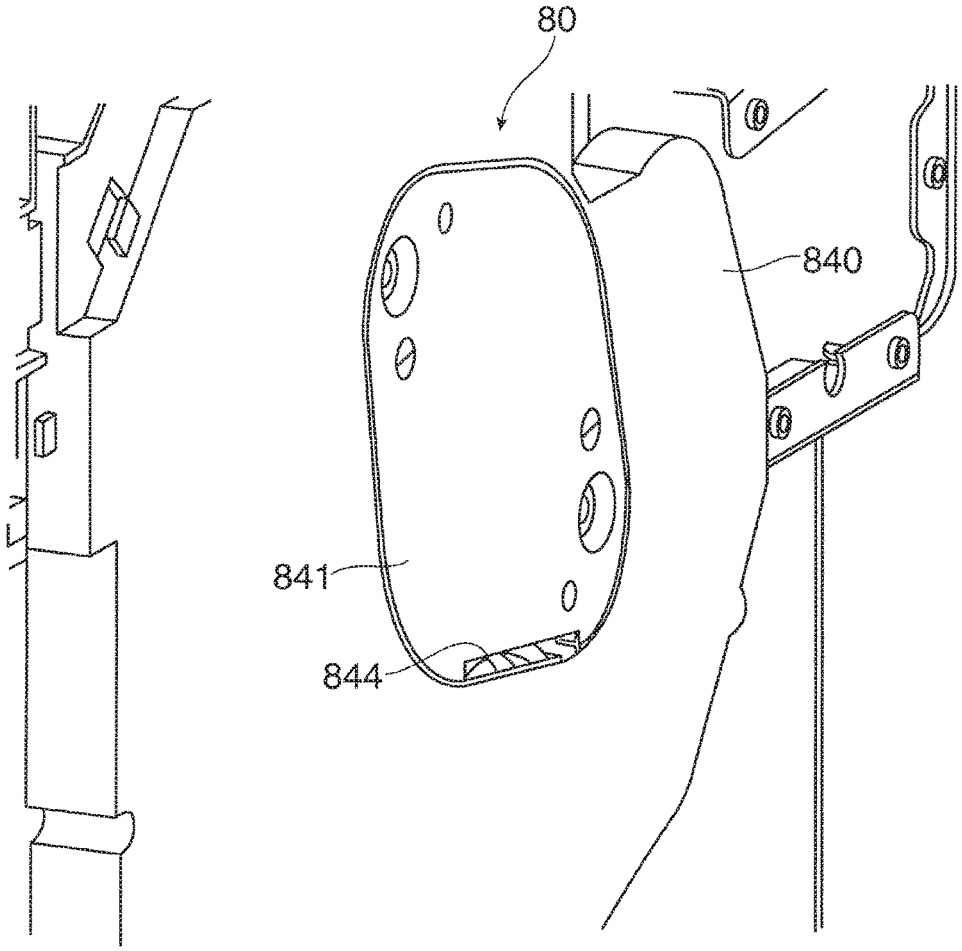
FIG. 6 is a side view of the structure of the right side frame.

As shown in FIGS. 5 and 6, at a central portion of the housing 840 of the driving device 80, a drum supporting cover (bracket) 841 is mounted on the right side frame 16 by, for example, a screw. The drum supporting cover 841 is formed with a substantially rhombic shape by using, for example, a metal plate; and rotatably supports an end portion of the photoconductor drum 21 in an axial direction via a bearing member (not shown). An open portion 842 corresponding to the shape of the drum supporting cover 841 is provided in a region of the right side frame 16 corresponding to the drum supporting cover 841. As shown in FIG. 4, a flange portion 843 is formed on an outer peripheral end edge of the drum supporting cover 841 by, for example, burring. The driving force transmission gear 831 for rotationally driving the photoconductor drum 21 is disposed at a lower portion of the drum supporting cover 841. A surface of the drum supporting cover 841 and a surface of the housing 840 of the driving device 80 are formed substantially flush with each other.

In order to avoid contact of an upper end portion of the driving force transmission gear 831, an open portion 844 that is formed by cutting away the flange portion 843 is provided in a lower end portion of the drum supporting cover 841. The open portion 844 constitutes the sound absorbing opening portion of the noise reducing structure according to the exemplary embodiment. The open portion 844 of the sound absorbing opening portion opens in the drum supporting cover 841 of the driving device 80, which is a noise source, and is formed near the noise source.

Figure 7:
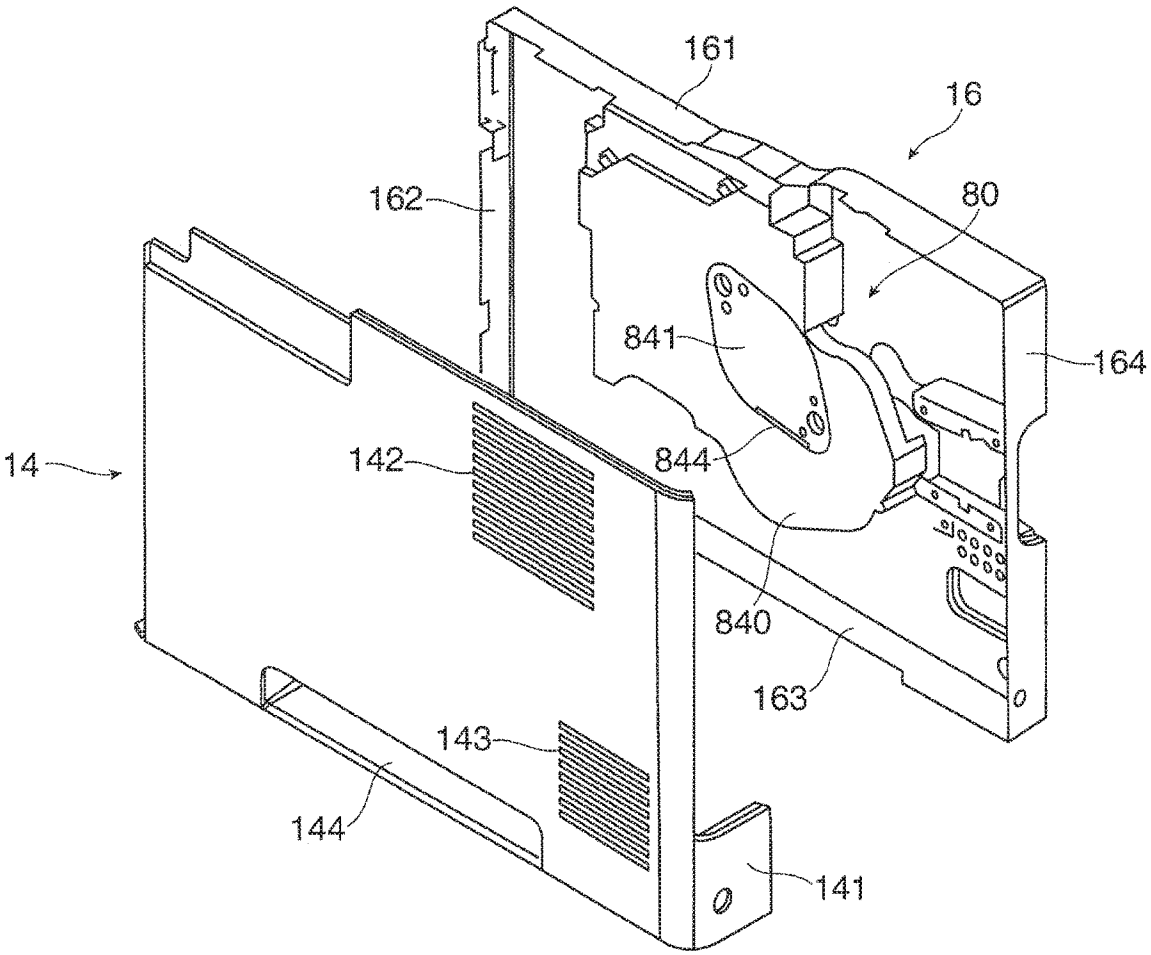
FIG. 7 is a perspective view of a structure of a right side cover and the structure of the right side frame.
Figure 8:
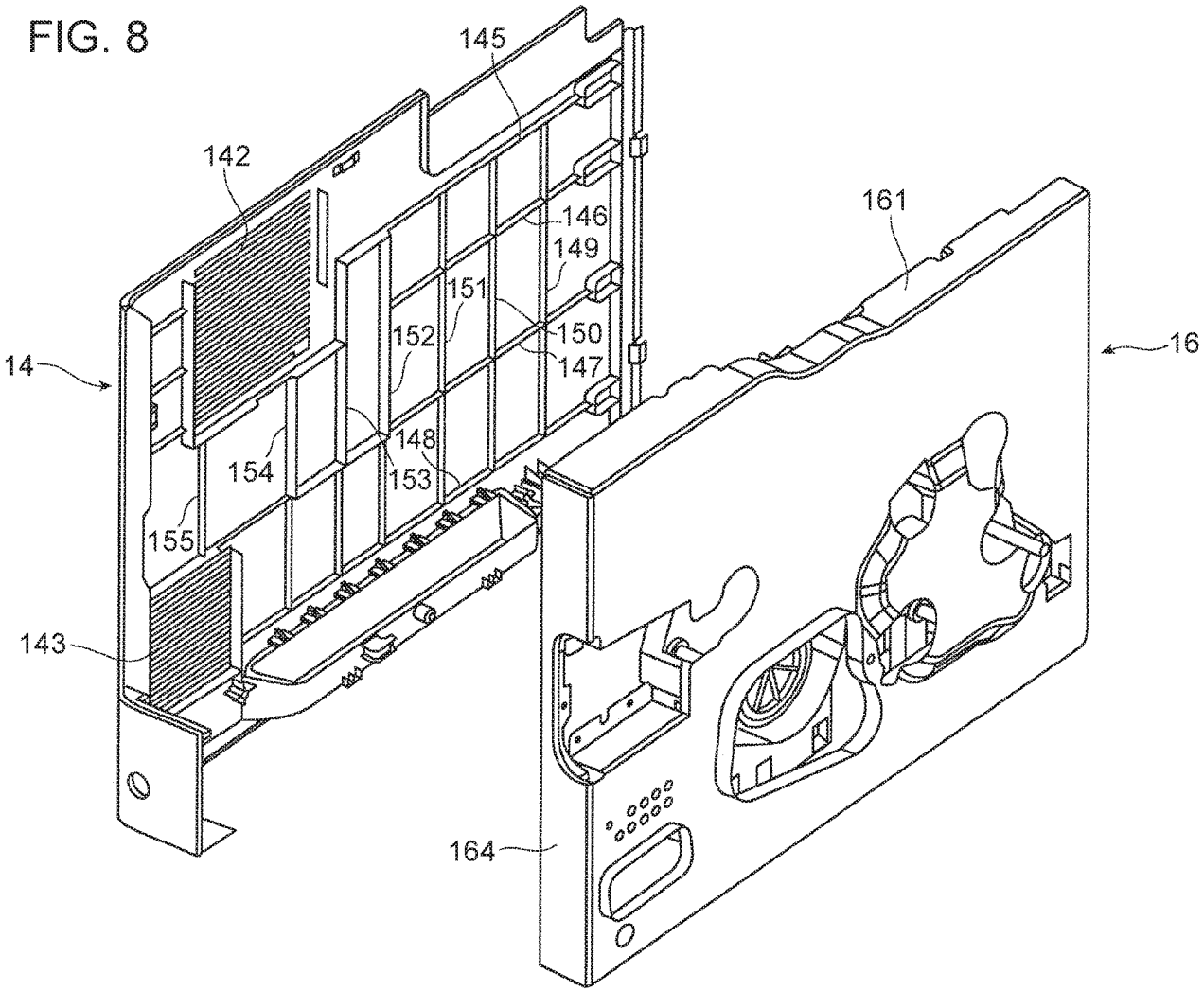
FIG. 8 is a perspective view of the structure of the right side cover and the structure of the right side frame.

As shown in FIGS. 7 and 8, the right side cover 14 is formed with a plate shape whose side surfaces have a substantially rectangular shape by subjecting, for example, synthetic resin to injection molding. A bending portion 141 is integrally provided at a lower end portion of the right side cover 14 on one side thereof. The bending portion 141 is bent for a short distance towards the rear surface side of the apparatus body 1*a*. An exhaust port 142 including louvers for preventing entry of foreign substances and having a relatively large opening area is formed at an upper end portion of the right side cover 14 on a rear surface side thereof. An air inlet 143 also including louvers for preventing entry of foreign substances and having a relatively small opening area is formed at a lower end portion of the right side cover 14 on the rear surface side thereof. In FIG. 7, reference numeral 144 denotes a holding portion provided in the center of the lower end portion of the right side cover 14. A hand is inserted into the holding portion 144 when holding the image forming apparatus 1.

As shown in FIG. 8, multiple reinforcing ribs 145 to 148 disposed parallel to each other along a lateral (horizontal) direction are provided in a region of the inner side surface of the right side cover 14 excluding the exhaust port 142 and the air inlet 143. The interval between the reinforcing rib 145 and the reinforcing rib 146 is smaller than the intervals between the other reinforcing ribs, that is, the reinforcing ribs 146 to 148. Multiple reinforcing ribs 149 to 155 disposed parallel to each other along a vertical (perpendicular) direction are provided in a region of the inner side surface of the right side cover 14 excluding the exhaust port 142 and the air inlet 143 so as to intersect the multiple reinforcing ribs 145 to 148. The interval between the reinforcing rib 154 and the reinforcing rib 155 is larger than the intervals between the other reinforcing ribs, that is, the reinforcing ribs 149 to 154. The reinforcing ribs 145 to 148 and the reinforcing ribs 149 to 155 on the right side cover 14 constitute an erected wall provided on the inner side surface of the right side cover 14 in an erected state to desired heights and thicknesses.

Of the reinforcing ribs 145 to 148 and the reinforcing ribs 149 to 155, the heights of parts of the reinforcing ribs 145 and 147 and the heights of parts of the reinforcing ribs 152, 153, and 154 are higher than those of the other reinforcing ribs.

Figure 9:
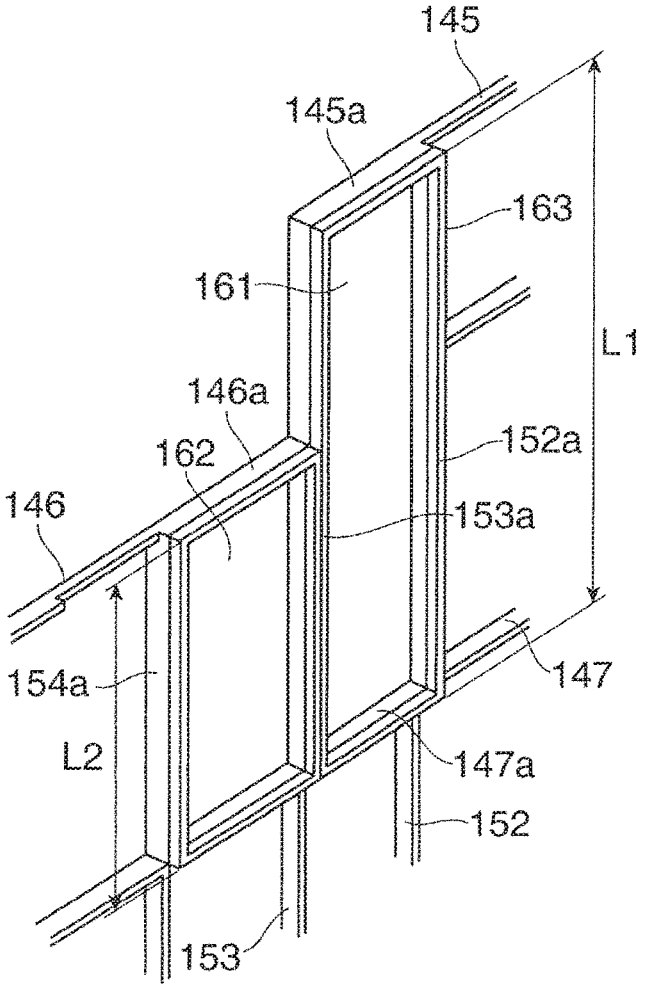
FIG. 9 is a perspective view of a structure of a portion of the right side cover.

More specifically, as shown in FIG. 9, a part 145*a* of the reinforcing rib 145, a part 146*a* of the reinforcing rib 146, a part 147*a* of the reinforcing rib 147, a part 152*a* of the reinforcing rib 152, a part 153*a* of the reinforcing rib 153, and a part 154*a* of the reinforcing rib 154, which exist in a region corresponding to the open portion 844 of the drum supporting cover 841 of the driving device 80, are higher than those of the other reinforcing ribs. At a location between the reinforcing rib 152 and the reinforcing rib 153 along the vertical direction, the reinforcing rib 146 along the lateral direction is not provided, and a first space portion 161 that is partitioned and defined by the vertical reinforcing ribs 152 and 153 and the horizontal reinforcing ribs 145 and 147 is formed. Since the reinforcing rib 146 along the lateral direction is not provided, a length L1 of the first space portion 161 is correspondingly long along the vertical direction. A second space portion 162 that is partitioned and defined by the vertical reinforcing ribs 153 and 154 and the horizontal reinforcing ribs 146 and 147 is formed in a region adjacent to the first space portion 161. A length L2 of the second space portion 162 is equal to the distance between the reinforcing rib 146 and the reinforcing rib 147 provided in the form of a lattice and along the lateral direction.

Figure 10:
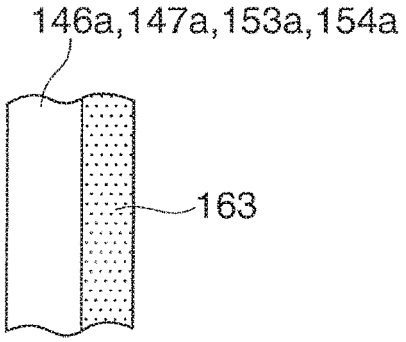
FIG. 10 illustrates a structure of a reinforcing rib.
Figure 11B:
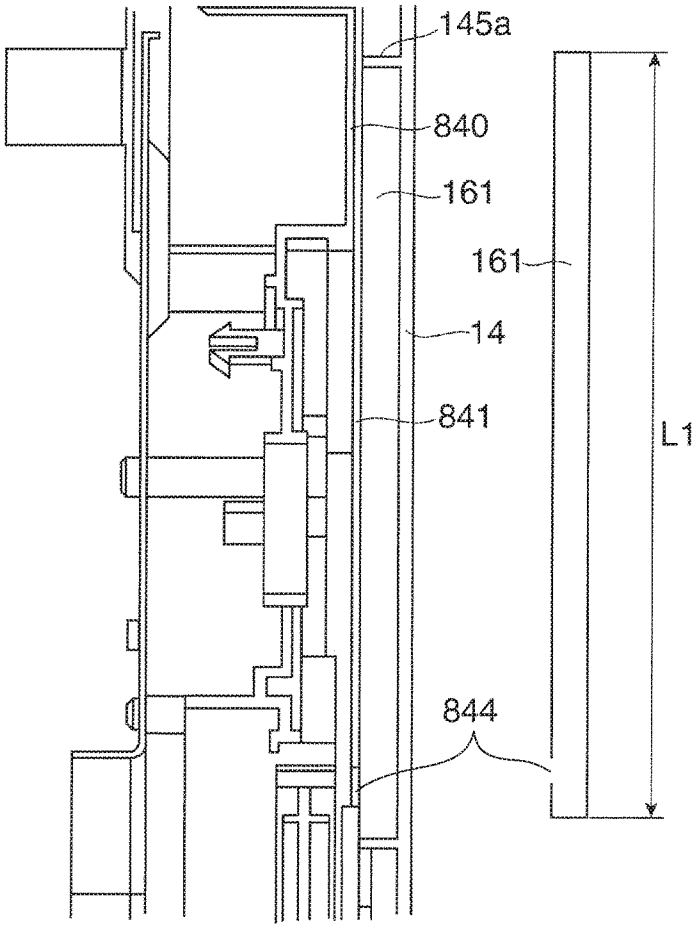
FIGS. 11A and 11B are each a perspective structural view of a state in which the right side cover is mounted.
Figure 11A:
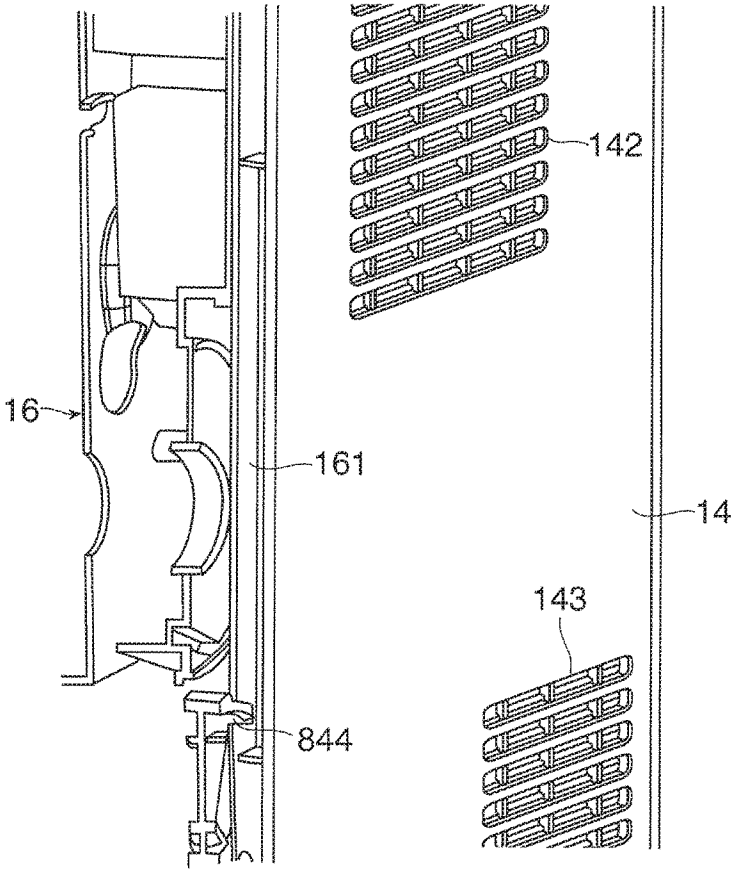

As shown in FIGS. 9 and 10, sealing members 163, made of, for example, urethane foam, are provided in protruding-direction end surfaces of the vertical reinforcing ribs 153 and 154 and the horizontal reinforcing ribs 146 and 147, which define the first space portion 161 and/or the second space portion 162. The sealing members 163 are provided in a protruding manner by, for example, affixation or adhesion by using a double-sided tape or the like. As shown in FIGS. 11A and 11B, when the right side cover 14 is mounted on the apparatus body 1*a*, ends of these sealing members 163 contact a side surface of the drum supporting cover 841 and a side surface of the housing 840 of the driving device 80 and form the first space portion 161 and the second space portion 162 as closed space portions.

The first space portion 161 and the second space portion 162 function as resonance tubes that reduce noise that leaks to the outside as a result of taking in the noise that is generated from the driving device 80 from the open portion 844 and causing it to resonate.

Figure 12:
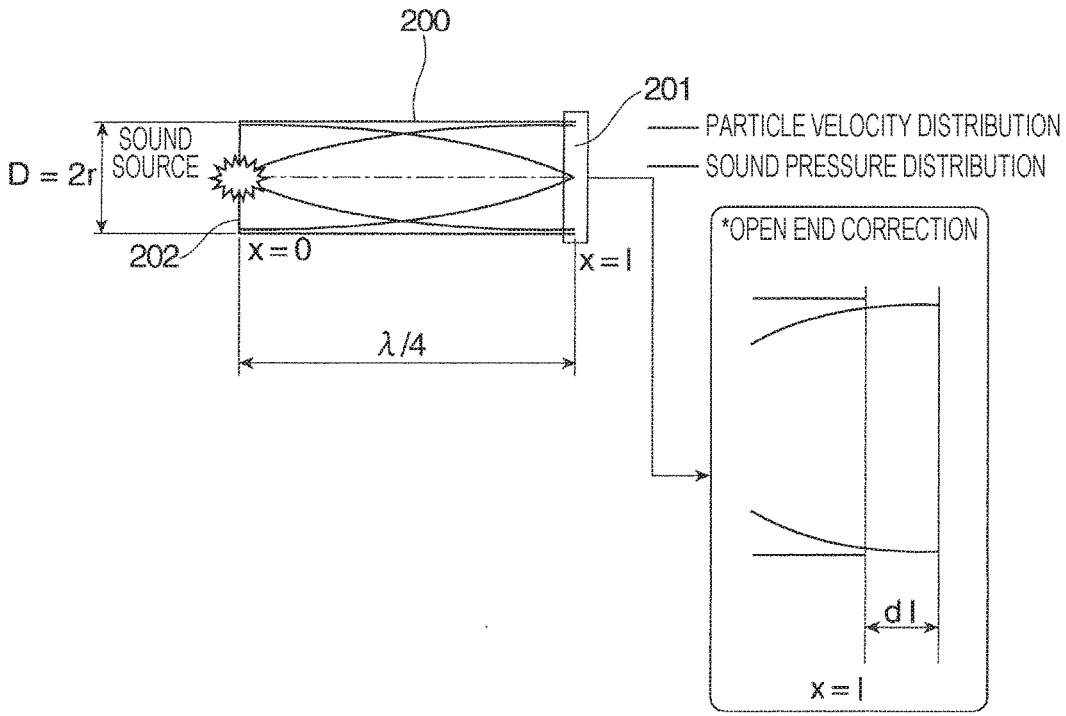
FIG. 12 is an explanatory view showing the principles of a resonance tube.

FIG. 12 is a schematic view showing the basic principles of a resonance tube.

When sound is incident upon a tube 200 (hereunder referred to as "resonance tube") having one end 201 open and the other end 202 closed, resonance occurs at a frequency dependent upon a length l of the resonance tube 200. As shown in FIG. 12, the other end 202 of the resonance tube 200 is located at a position that has coordinate x=0, and the one end 201 of the resonance tube 200 is located at a position that has coordinate x=l. Therefore, by setting the length l of the resonance tube 200 as appropriate, it is possible to cause sound having a target frequency to resonate. In addition, when a sound absorbing material or a sound absorbing mechanism is provided in the inside of the resonance tube 200 (an antinode of particle velocity or an antinode of sound pressure), it is possible to obtain a noise reducing effect of reducing the incident sound. The one end 201 may be closed, in which case the sound pressure distribution of the one end 201 becomes a node. In general, when the one end 201 is closed, the length L of the resonance tube 200 may be $l=\lambda/4$, which is shorter than the length $l=\lambda/2$ of the resonance tube 200 when the one end 201 is open.

Conditions under which a plane wave is produced in the inside of the resonance tube 200 is a range that satisfies $D<0.56\lambda$ when the cross section of the resonance tube 200 is circular, and is a range that satisfies $D<0.50\lambda$ when the cross section of the resonance tube 200 is rectangular. D denotes the diameter of the resonance tube 200, r denotes the radius of the resonance tube 200, λ denotes the wavelength of the resonating sound (=sound velocity/frequency), l denotes the length of the resonance tube 200, and dl denotes an open end correction value (=0.85r) for correcting a length for the wavelength of resonating sound provided by the open end 201.

Figure 13A:
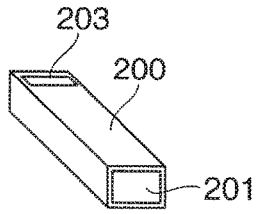
FIGS. 13A to 13C are each an explanatory view of a structure of the resonance tube.

FIG. 13A schematically illustrates a basic structure of the long, narrow resonance tube 200 having a rectangular parallelepiped shape.

The resonance tube 200 has, for example, a tubular shape that is rectangular in cross section. The resonance tube 200 includes a sound absorbing opening portion 203 in a surface of one end portion that is closed along a longitudinal direction of the resonance tube 200. The end portion 201 of the resonance tube 200 that is opposite to the sound absorbing opening portion 203 along the longitudinal direction of the resonance tube 200 is entirely open.

Figure 13B:
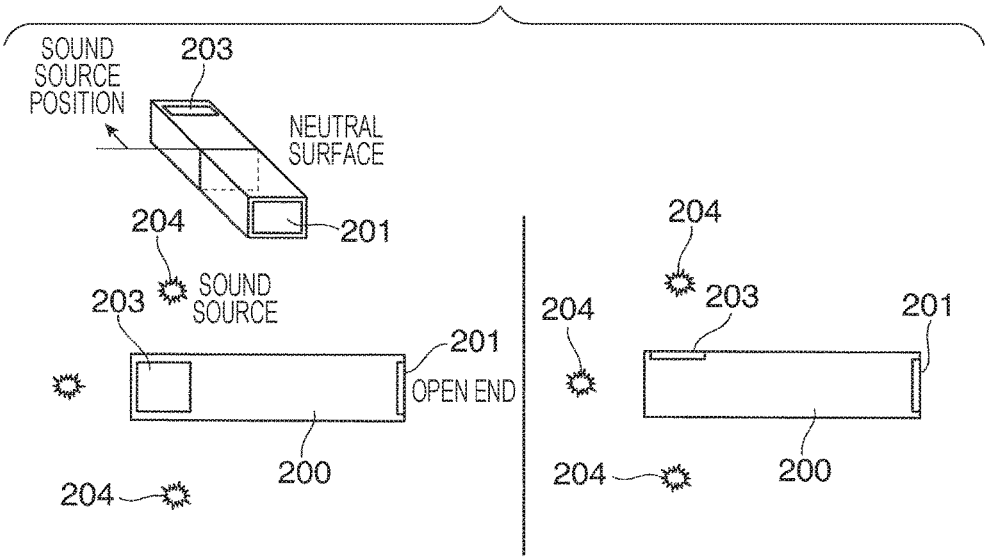

As shown in FIG. 13B, in such a resonance tube 200, sound sources 204 may be positioned at, for example, an outer portion of the resonance tube 200 along a longitudinal direction of the sound absorbing opening portion 203 or at two side portions along a direction that intersects the longitudinal direction. It is most desirable that the sound sources 204 be disposed at locations opposing the sound absorbing opening portion 203 of the resonance tube 200. Alternatively, the sound sources 204 may be positioned in a plane of the resonance tube 200 opposite to the sound absorbing opening portion 203.

Figure 13C:
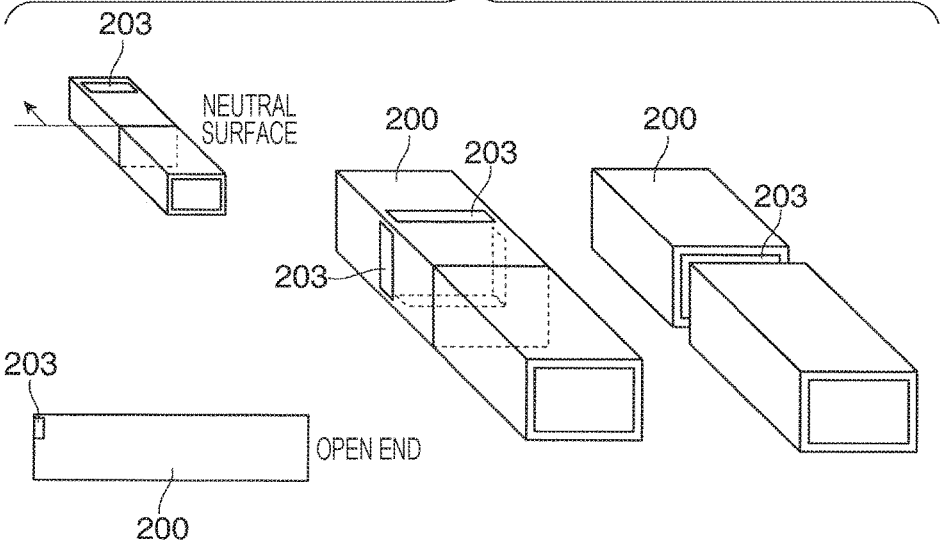

As shown in FIG. 13C, the positional relationship of the sound absorbing opening portion 203 with respect to the resonance tube 200 is to be such that the sound sources 204 are positioned on a side of the sound absorbing opening portion 203 with respect to a neutral surface of the resonance tube 200 along the longitudinal direction. The sound absorbing opening portion 203 may also be disposed in an end surface of the resonance tube 200 along the longitudinal direction thereof. Further, instead of being open in one surface of the resonance tube 200, the sound absorbing opening portion 203 may be divided into portions and the portions may open in four surfaces of the resonance tube 200. Alternatively, the sound absorbing opening portion 203 may open continuously over four surfaces of the resonance tube 200, and may consequently open with the resonance tube 200 divided in two.

In the first exemplary embodiment shown in FIG. 9, the first space portion 161 constitutes a resonance tube 200 having the length L1. The second space portion 162 constitutes a resonance tube 200 having the length L2. For example, when the first space portion 161 is to cause the resonance tube 200 to function as a resonance tube in which sound having a frequency of 500 Hz is caused to resonate, since the wavelength of sound=the sound velocity/the frequency, L1=approximately 17 cm if the length L1 is set at $\lambda/4$. For example, when the second space portion 162 is to cause the resonance tube 200 to function as a resonance tube in which sound having a frequency of 1000 Hz is caused to resonate, since the wavelength of sound=the sound velocity/the frequency, L2=approximately 8.5 cm if the length L2 is set at $\lambda/4$. The length L1 of the first space portion 161 and the length L2 of the second space portion 162 are not limited to $\lambda/4$ of the sound wavelength λ, and may obviously be set at $\lambda/2$, $1\lambda$, $2\lambda$, . . . .

Action of Image Forming Apparatus

In the image forming apparatus 1 according to the exemplary embodiment, even if it is difficult to provide spaces having sufficient volumes, space portions that are formed by the exterior covers and the internal structural body may be used to suppress noise that is generated from a noise source as follows.

In the image forming apparatus 1, when the controlling device 100 receives command information regarding a request for an image forming operation (print), the driving device 80 drives, for example, the image forming unit 2, the sheet-feeding unit 4, the transporting unit 5, and the fixing unit 6.

As shown in FIG. 3, in the driving device 80, the driving motor 81 is rotationally driven, and rotational driving force of the driving motor 81 is transmitted to the rotary bodies, such as the photoconductor drum 21 of the image forming unit 2, via, for example, the driving force transmission gears 821 to 830 and 831.

At this time, the driving device 80 generates driving noises resulting from, for example, meshing of the driving force transmission gears 821 to 830 and 831. Of the driving noises resulting from the meshing of the driving force transmission gears 821 to 830 and 831, in particular, the driving noise resulting from the meshing of the driving force transmission gear 831 having a large outside diameter tends to have a low frequency of 1000 Hz or less because the rotation speed of the driving force transmission gear 831 having the large outside diameter is less than the rotation speeds of driving force transmission gears having small outside diameters.

As shown in FIG. 11, the noises generated from, for example, the driving force transmission gears 821 to 830 and 831 of the driving device 80 are introduced into the first space portion 161 and the second space portion 162 via the open portion 844, which functions as a sound absorbing opening portion, and a sound having a wavelength 2 corresponding to the length L1 of the first space portion 161 and the length L2 of the second space portion 162 resonates. Therefore, the noises that are generated from the driving device 80 resonate in the inside of the first space portion 161 and in the inside of the second space portion 162, and discharge of the noises to the outside of the image forming apparatus 1 is prevented or suppressed.

Second Exemplary Embodiment

Figure 14:
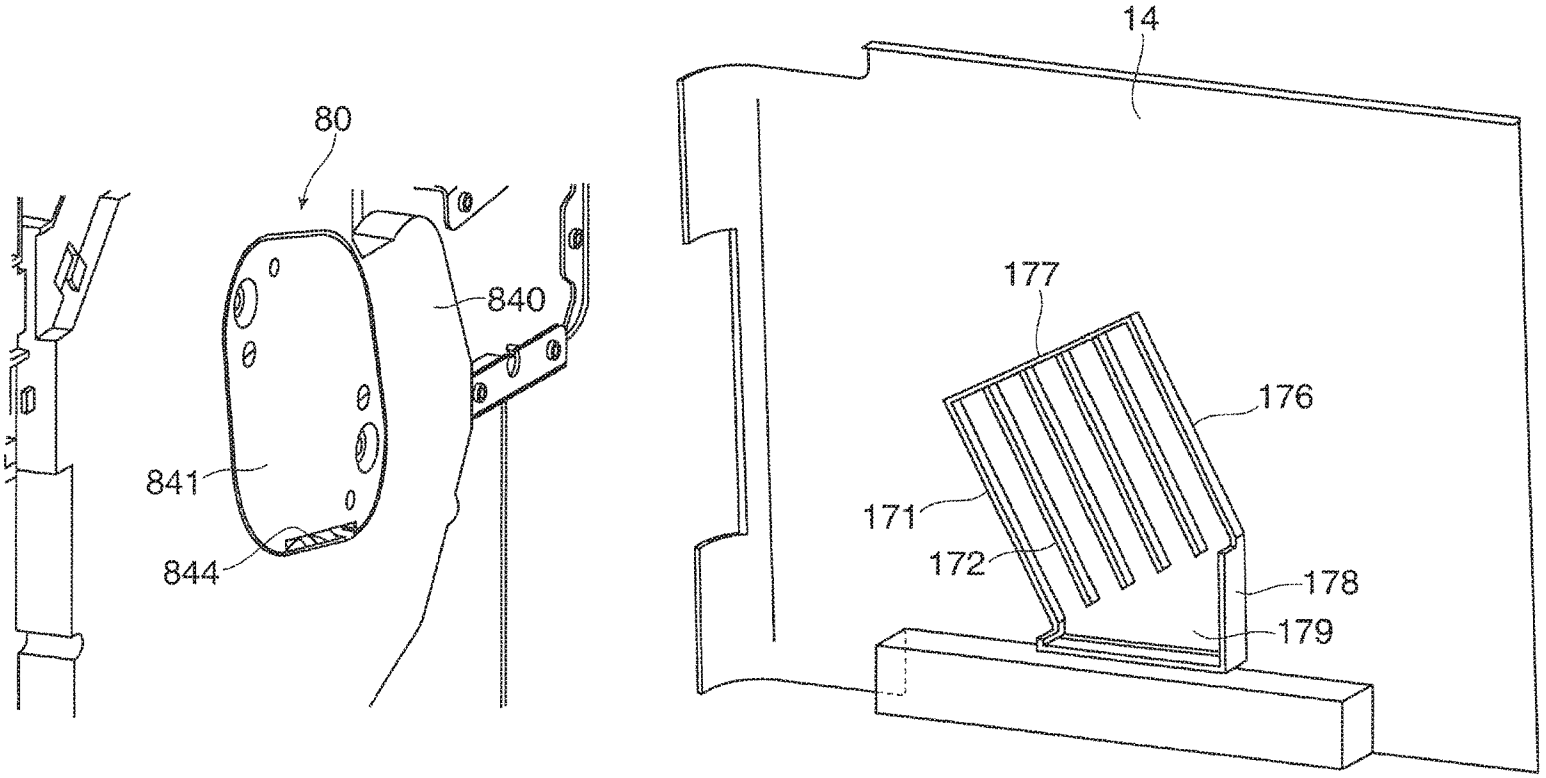
FIG. 14 is a schematic view of a structure of an image forming apparatus to which a noise reducing structure according to a second exemplary embodiment of the present invention is applied.

FIG. 14 schematically illustrates an entire image forming apparatus 1 to which a noise reducing structure according to a second exemplary embodiment is applied.

As shown in FIG. 14, the image forming apparatus 1 according to the second exemplary embodiment includes a side cover 14 as an exemplary exterior body. The side cover 14 is openably and closably mounted on an apparatus body 1*a*. The side cover 14 is disposed so as to cover an outer side surface of a driving device 80 of the apparatus body 1*a*. Multiple reinforcing ribs 171 to 176 that are tilted so as to be parallel to each other are integrated with an inner side surface of the side cover 14. Spaces that are formed by one end portion of each of the multiple reinforcing ribs 171 to 176 are closed by a reinforcing rib 177. Spaces that are formed by the other end portion of each of the multiple reinforcing ribs 171 to 176 are open. In addition, a closed space 179 formed with side surfaces that form a substantially triangular shape by a reinforcing rib 178 is provided so as to communicate with the open spaces formed by the other end portion of each of the multiple reinforcing ribs 171 to 176. A sound attenuating member (not shown) that attenuates sound and that is made of, for example, sponge is accommodated in the closed space 179 as appropriate.

By closing the spaces formed by the multiple reinforcing ribs 171 to 177 that are adjacent to each other, the open sides are closed to constitute multiple resonance tubes formed by closed spaces. In this way, by closing the open sides of the multiple reinforcing ribs 171 to 177 by the side cover 14, the open sides of the multiple reinforcing ribs 171 to 177 are closed by a drum supporting cover 841 and a housing 840 of the driving device 80. When the lengths of the multiple resonance tubes formed by the multiple reinforcing ribs 171 to 177 are made to differ from each other, it is possible to cause sounds having different wavelengths to resonate.

Although, in the exemplary embodiments, a monochrome image forming apparatus that forms a black toner image is described as the image forming apparatus, the type of image forming apparatus is not limited thereto. Obviously, as the image forming apparatus, a full-color image forming apparatus that forms toner images of four colors, yellow (Y), magenta (M), cyan (C), and black (K) may also be similarly used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A noise reducing structure comprising:

an internal structural body that includes a bracket supporting a driving device;

an exterior body that includes an inner side surface facing the internal structural body and that covers an outer side of the internal structural body;

a space portion that is surrounded by an erected wall, the bracket, and the inner side surface, the erected wall being erected so as to, from one of the bracket and the inner side surface towards the other of the bracket and the inner side surface, extend to be in contact with the other of the bracket and the inner side surface; and a sound absorbing opening portion that is connected to the space portion and that is formed at a portion near the driving device.

2. The noise reducing structure according to claim 1, wherein the erected wall includes a plurality of reinforcing ribs that reinforce the exterior body.

3. The noise reducing structure according to claim 2, wherein a plurality of pairs of the erected walls are provided so as to face each other, and wherein lengths of a plurality of the space portions surrounded by the pairs of the erected walls differ from each other.

4. The noise reducing structure according to claim 3, wherein a sound absorbing material is disposed inside the space portion at a position corresponding to an antinode of a sound pressure of a sound wave.

5. An image forming apparatus comprising:

the noise reducing structure according to claim 3, wherein the internal structural body includes a driving device that drives an image forming unit.

6. The noise reducing structure according to claim 2, wherein a sound absorbing material is disposed inside the space portion at a position corresponding to an antinode of a sound pressure of a sound wave.

7. An image forming apparatus comprising:

the noise reducing structure according to claim 2, wherein the internal structural body includes a driving device that drives an image forming unit.

8. The noise reducing structure according to claim 1, wherein a plurality of pairs of the erected walls are provided so as to face each other, and wherein lengths of a plurality of the space portions surrounded by the pairs of the erected walls differ from each other.

9. The noise reducing structure according to claim 8, wherein a sound absorbing material is disposed inside the space portion at a position corresponding to an antinode of a sound pressure of a sound wave.

10. An image forming apparatus comprising:

the noise reducing structure according to claim 8, wherein the internal structural body includes a driving device that drives an image forming unit.

11. The noise reducing structure according to claim 1, wherein when the exterior body is closed, the exterior body faces the bracket of the internal structural body.

12. The noise reducing structure according to claim 11, wherein a sound absorbing material is disposed inside the space portion at a position corresponding to an antinode of a sound pressure of a sound wave.

13. An image forming apparatus comprising:

the noise reducing structure according to claim 11, wherein the internal structural body includes a driving device that drives an image forming unit.

14. The noise reducing structure according to claim 1, wherein a sound absorbing material is disposed inside the space portion at a position corresponding to an antinode of a sound pressure of a sound wave.

15. An image forming apparatus comprising:

the noise reducing structure according to claim 1, wherein the internal structural body includes a driving device that drives an image forming unit.

16. The noise reducing structure according to claim 1, wherein the sound absorbing opening portion is an open portion that opens in the bracket.

17. The noise reducing structure according to claim 16, wherein the space portion comprises a plurality of sub-space portions surrounded by the erected wall, the bracket, and the inner side surface, and the sound absorbing opening portion is located opposite the plurality of sub-space portions.

* * * * *